US005638091A

United States Patent [19]

Sarrasin

[11] Patent Number: 5,638,091

[45] Date of Patent: Jun. 10, 1997

[54] PROCESS FOR THE DISPLAY OF DIFFERENT GREY LEVELS AND SYSTEM FOR PERFORMING THIS PROCESS

[75] Inventor: Denis Sarrasin, Sassenage, France

[73] Assignee: Commissariat a L'Energie Atomique, France

[21] Appl. No.: 338,570

[22] PCT Filed: May 10, 1993

[86] PCT No.: PCT/FR93/00481

§ 371 Date: Nov. 17, 1994

§ 102(e) Date: Nov. 17, 1994

[87] PCT Pub. No.: WO93/23841

PCT Pub. Date: Nov. 25, 1993

[30] Foreign Application Priority Data

May 21, 1992 [FR] France ..... 92 06206

[51] Int. Cl.[6] ..... G09G 5/10

[52] U.S. Cl. ..... 345/147; 345/148; 345/149

[58] Field of Search ..... 345/147, 148, 345/149

[56] References Cited

U.S. PATENT DOCUMENTS

| | | | |
|---|---|---|---|
| 4,921,334 | 5/1990 | Akodes | 350/333 |
| 5,030,947 | 7/1991 | Dieudonne et al. | 345/147 |
| 5,138,308 | 8/1992 | Clerc et al. | 345/147 |
| 5,196,738 | 3/1993 | Takahara et al. | 345/147 |
| 5,198,803 | 3/1993 | Shie et al. | 345/147 |
| 5,453,757 | 9/1995 | Date et al. | 345/147 |
| 5,495,287 | 2/1996 | Kasai et al. | 345/147 |

FOREIGN PATENT DOCUMENTS

| | | | |
|---|---|---|---|
| 0391655 | 10/1990 | European Pat. Off. | G09G 3/36 |
| 0479450 | 4/1992 | European Pat. Off. | G09G 1/20 |
| 0478386 | 4/1992 | European Pat. Off. | G09G 3/36 |

*Primary Examiner*—Richard Hjerpe
*Assistant Examiner*—Juliana S. Kim
*Attorney, Agent, or Firm*—Hayes, Soloway, Hennessey, Grossman & Hage, P.C.

[57] ABSTRACT

The invention relates to a method for displaying different levels of grey on a matrix screen including pixels arranged along R rows and M columns of images having $Q_S$ levels of grey and obtained by addition to each pixel during the writing of image data line-by-line, during Sub-times (lines or frames, S being at least 2), of a succession of discrete luminance levels selected from among N such that any grey hue included between 0 and $Q_{S-1}$ may be defined by the addition of S said luminance levels. The invention also relates to a system for implementing such method. Particular utility for the present invention is found in the area of displaying data on micropoint screens.

7 Claims, 5 Drawing Sheets

PRIOR ART

PROCESS FOR THE DISPLAY OF DIFFERENT GREY LEVELS AND SYSTEM FOR PERFORMING THIS PROCESS

BACKGROUND OF THE INVENTION

1. Field of the Invention

The invention relates to a process for the display of different grey levels and to a system for performing this process.

The display system according to the invention is more particularly applicable to microtip screens.

In the present description the term "grey tone" covers tints.

2. Brief Description of Related Prior Art

In the display field, the standard addressing processes have been described by T. Leroux, A. Ghis, R. Meyer and D. Sarrasin in an article entitled "Microtip Display Addressing" (SID 91 Digest pp.437–439). This article makes a distinction between two addressing types:

an analog addressing consisting of sampling an analog source signal (e.g. of the video type); and a pulse width modulation (PWM) addressing based on the time division switching of the column voltage.

The analog solution can be satisfactory for television applications. However, the existing technology for matrix screen control circuits only permits sampling levels of approximately 5 MHz, which is inadequate for data processing applications. For example, the "data" clock for a VGA screen (existing screen of standard size) is approximately 25 MHz. In addition, for data processing there is a digital data source. Therefore an analog control mode requires a supplementary stage of transforming the source signal by means of a digital—analog converter.

The digital solution can be obtained with the aid of several known processes.

A time modulation of the pulse width modulation (PWM type) consists, with a circuit able to switch at the output two voltage levels (making it possible to select the ON and OFF states, of modulating the duration of the ON state of the column in question during the row selection. This type of addressing functions well for the display of a small number of grey tones, e.g. 16. However, for the correct transmission of a grey tint, the selection times must be long compared with the rise times of the signals. However, for a VGA screen (640 columns, 480 rows) scanned at the field or frame frequency of 70 Hz, the row selection time is max. 1/(70×480) approximately equal to 30 μs. For 16 grey tones, the smallest selection period is therefore 30 μs/16 which is approximately equal to 2 μs and for 256 tones: 30 μs/256 which is approximately equal to 120 ns. The order of magnitude of the rise times, linked with the output impedance of the column circuits and the capacity of the column of the screen, is one hundred to a few hundred nanoseconds. Thus, this method can be satisfactory for 16 grey tones, but is certainly not for 256.

A time modulation of the frame rate control (FRC) type consists of performing several scans of the image by successively allocating ON or OFF states to the same pixels, the eye serving as the integrator. This modulation is also limited with regards to the number of grey tones, because the multiple addressing of the same image element on the one hand leads to high frequencies at the level of the data flow on entering the circuits and on the other to excessively short selection periods on the outputs. In practice, there are screens displaying 32 grey tones with this method. However, these are liquid crystal screens of the STN (super twisted nematic or multiplexed LCD type), whose response times of approximately 200 to 300 ms make it possible to completely renew the information of a pixel with times exceeding that of the persistence of vision. Such a method is illustrated in European patent applications 384 403-A2 of SEIKO and 364 307-A2 of COMPAQ.

A method using multilevel circuits consists of using circuits able to switch N different voltage levels (in practice N=8 or N=16). The analog output multiplexer ensuring the switching of relatively high voltages consequently has a relatively large "silicon" size. Moreover, for each output there is a multiplexer. It is therefore scarcely possible to envisage more than 16 switchable channels.

Such multilevel circuits can be associated with the FRC method, as described in the article by H. Mario, T. Furukashi and T. Tanaka entitled "Multicolor Display Control Method for TFT-LCD" (SID 91 Digest pp.547–550). It is a question of using multilevel circuits (analog multiplexers), e.g. eight such circuits, and performing two scans of the screen (frame 1 and frame 2). Frame 1 is representative of the low orders and is obtained by using a first set of eight voltages applied to the multiplexers, whereas the second represents the high orders and is obtained by means of a second set of eight voltages different from the first voltages.

FIG. 1 illustrates this method by giving a mimic diagram example for sixty four grey levels with two sets of eight different voltage levels.

In FIG. 1 a source 10 of digital data to be displayed supplies digital data to three logic multiplexers 11 having two inputs and one output, the bits of order 1, 2 and 4 being respectively connected to a first input of said multiplexers 11, whilst the bits of order 8, 16 and 32 are respectively connected to the second input of said multiplexers 11.

The three outputs of these multiplexers are respectively connected to three data storage circuits 12 comprising shift registers associated with storage registers or latches.

A generator 15 supplies a first set of eight voltages $V_{0a}$ to $V_{7a}$ and a second set of eight voltages $V_{pb}$ to $V_b$, which are connected pairwise to the inputs of eight "high" voltage multiplexers 14 having two inputs and one output.

A controller 16 connected to the data source 10 supplies a control signal ST, which is supplied to each of the logic multiplexers 11 and to each of the "high" multiplexers 14.

A column control circuit 13 of the screen 17 receives on the one hand the outputs of the circuits 12 and on the other those of the "high" voltage multiplexers 14. This control circuit 13 is formed from eight analog multiplexers having eight inputs and one output.

FIG. 1 does not show the row control circuit, which can be of a conventional nature, e.g. using shift registers making it possible to successively select one by one the rows of the screen.

The data source comprises a memory for storing the data corresponding to a screen page. The signal ST, connected to all the multiplexers 11 and 14, with two inputs and an output, is a frame parity multiplexer selection signal.

Such a method requires sixteen voltage values for 64 grey levels (and twenty four if it is wished to apply it to two hundred and fifty six levels on three frames) with relatively high precision levels.

For example, for sixty four levels (with data on six bits), we have the orders:

$$2^0=1\ 2^1=2\ 2^2=4\ 2^3=8\ 2^4=16\ 2^5=32$$

the first frame having to represent the orders 1, 2 and 4 of said data and the second the orders 8, 16 and 32, so that there are the following luminance or brightness levels on the screen 17:

| | |
|---|---|
| $L(V_{0a}) = 0$ | $L(V_{0b}) = 0$ |
| $L(V_{1a}) = 1 \times L(V_{1a})$ | $L(V_{1b}) = 8 \times L(V_{1a})$ |
| $L(V_{2a}) = 2 \times L(V_{1a})$ | $L(V_{1b}) = 16 \times L(V_{1a})$ |
| $L(V_{3a}) = 3 \times L(V_{1a})$ | $L(V_{1b}) = 24 \times L(V_{1a})$ |
| $L(V_{4a}) = 4 \times L(V_{1a})$ | $L(V_{1b}) = 32 \times L(V_{1a})$ |
| $L(V_{5a}) = 5 \times L(V_{1a})$ | $L(V_{1b}) = 40 \times L(V_{1a})$ |
| $L(V_{6a}) = 6 \times L(V_{1a})$ | $L(V_{1b}) = 48 \times L(V_{1a})$ |
| $L(V_{7a}) = 7 \times L(V_{1a})$ | $L(V_{1b}) = 56 \times L(V_{1a})$ |

Such a method leads to a reduction of the contrast of the screen, because half the effective addressing time is devoted to the display of a low order level. For example, for a display of the white with two frames for sixty four grey levels, we obtain:

for frame 1:$L(V_a)=7\times L(V_1)$ for frame 2:$L(V_b)=56\times L(V_1)$.

Therefore the overall efficiency is only 9/16 which, with two subframes, gives a luminance loss for the white of approximately 40%.

SUMMARY OF THE INVENTION

The invention relates to a process for the display on a matrix screen constituted by pixels arranged in accordance with R rows and M columns of images liable to have a discrete number of $Q_S$ grey tones, obtained by addition on each pixel, during a writing process for the data of images on a row by row basis during S sub-times of identical duration (rows or frames; $S\geqq 2$) of a succession of discrete brightnesses L(Vi) chosen from among N ($N\geqq 4$) with $0\leqq i\leqq N-1$, each brightness L(Vi) being associated with a voltage Vi applied to the corresponding column, said brightnesses being such that any grey tone value between 0 and $Q_S-1$ can be defined by the addition of S of said brightnesses and more particularly no matter what the addressing phase, i.e. sub-times taking place, any brightness among the N possibles is selectable:

said brightnesses being such that on defining two extreme brightnesses $L(V_0)$ corresponding to the minimum brightness and $L(V_{N-1})$ corresponding to the maximum brightness by the following equations:

$$L(V_o)=\alpha\epsilon \text{ and } L(V_{N-1})=\alpha K_a+L(V_o)$$

$\epsilon$ being a low value and $\alpha$ a proportionality coefficient equal to $(L(V_{N-1})-L(V_0))/Ka$ in which $K_a$ is a coefficient represented by $a=(N/4)-1$, the N−2 other brightnesses then being expressed by the following relations:

$$\begin{aligned}
L(V_{N-2}) &= \alpha(K_a - 1) + L(V_o)\\
L(V_{N-3}) &= \alpha(K_a - (S + 1)) + L(V_o)\\
L(V_{N-4}) &= \alpha(K_a - 2s) + L(V_o)\\
L(V_{N-5}) &= \alpha K_{a-1} + L(V_o)\\
L(V_{N-6}) &= \alpha(K_{a-1}{}^{-1}) + L(V_o)\\
L(V_{N-7}) &= \alpha(K_{a-1} - (S + 1)) + L(V_o)\\
L(V_{N-8}) &= \alpha(K_{a-1} - 2s) + L(V_o)\\
L(V_{N-9}) &= \alpha K_{a-2} + L(V_o)\\
&\vdots\\
L(V_7) &= \alpha K_1 + L(V_o)\\
L(V_6) &= \alpha(K_1 - 1) + L(V_o)
\end{aligned}$$

-continued $$\begin{aligned}
L(V_5) &= \alpha K_1 - (S + 1) + L(V_o)\\
L(V_4) &= \alpha(K_1 - 2S) + L(V_o)\\
L(V_3) &= \alpha \cdot 2S + L(V_o)\\
L(V_2) &= \alpha(S + 1) + L(V_o)\\
L(V_1) &= \alpha + L(V_o)
\end{aligned}$$

in which $K_x$, with x ranging between a and 1, are the coefficients (N/4)−1 respectively allocated to a group of four brightnesses, $K_x$ being such that:

for x=1, if S is uneven $K_1\leqq S^2+4S$ if S is even $K_1\leqq S^2+5S-1$ for x between (a-1) and 2 if S is uneven $K_x\leqq K_{x-1}+S^2+2S$ if S is even $K_x\leqq K_{x-1}+S^2+3S-1$ and for x=a, no matter what S, $(Q-1)/S\geqq K_a\geqq(Q_S-1)/S$.

These N selectable brightnesses are obtained by the adjustment of the N voltages $V_o, \ldots, V_{N-1}$ and make it possible to obtain a selectable grey number Q ($Q\geqq Q_S$) equal to:

if S is uneven, $Q=S\ (aS^2+(2a+2).S)+1$ if S is even, $Q=S\ (aS^2+(3a+2).(S-a))+1$ and for N=4 $Q=(S+1)^2$ with $L(V_o)=\alpha\epsilon$ $L(V_1)=\alpha+L(V_0)$, $L(V_2)=\alpha(S+1)+L(V_o)$ and $L(V_3)=\alpha(S+2)+L(V_o)$.

Advantageously the process for implementing the system according to the invention comprises the following stages:

supplying from a source of images to be displayed a data item in the form of a binary address corresponding to the code of the grey level to be displayed in a transcoding matrix;

supplying simultaneously sync signals to a screen controller so that it successively supplies the addresses of the S sub-times either to the transcoding matrix, or to a logic multiplexer positioned upstream of the analog multiplexer controlling the screen, said analog multiplexer being connected to a generator of at least N voltages;

for a given sub-time, supplying the address of the voltage to be switched from the transcoding process to an array of shift registers associated with storage registers or latches;

transfer of the content of the associated registers into screen analog control multiplexers either directly, or across a logic multiplexer; and switching the selected voltage on the column of the screen.

Advantageously the combination of the voltage values takes place in accordance with a rising or falling arrangement. In the case of row sub-times, it is also possible to follow a rising order for one row parity and a falling order for the other row parity.

The invention also relates to a system permitting the performance of said grey level display process by the digital method on the matrix screen. More particularly, said system comprises a source of digital data to be displayed, a screen controller receiving sync signals from the data source, which successively supplies the addresses of the S sub-times to a transcoding circuit, a data storage system, a screen column control circuit, a generator of at least N discrete voltages, characterized in that it also comprises the transcoding circuit connected to the digital data source receiving from the latter the binary addresses corresponding to the code of the grey level to be displayed and in particular supplying the address of the voltage to be switched to a control circuit making it possible to validate one among N discrete analog voltages.

In a first variant the screen controller is connected to the data storage system. The data storage system comprises shift registers associated with latches. The screen column control circuit has several circuits making it possible to select one from among several discrete voltages, said voltage controlling the considered column of the screen.

In a second variant, the screen controller is directly connected to the screen control means. The transcoding circuit has transcoding submatrixes, each corresponding to a sub-time. The data storage system has shift registers in parallel and each associated with a register and each connected to a transcoding submatrix. The screen column control circuit has circuits making it possible to select one from among several discrete voltages, said voltage controlling the considered column of the screen and digital multiplexers connected to the controller and positioned between the associated registers and the said circuits.

Advantageously the system according to the Invention makes it possible to mix the solely time mode (PWM method: subdividing the row time into S row sub-times) and the solely voltage mode (choice between n output voltages for the column circuit) so as to give a mixed time/voltage mode with a distribution grid which, whilst avoiding both code "holes" and brightness losses, makes it possible to attain a large number of grey levels with a minimum of voltage and time inputs.

This system makes it possible to satisfy several criteria:

voltage multiplexer limited as regards the number of channels;

minimizing the number of necessary row sub-times (in order to give access to more complex screens); and the maximum number of voltages used remaining close to those of a solely black and white addressing, so that all the voltages can be applied to any random sub-time.

DETAILED DESCRIPTION OF EMBODIMENTS

In known manner, the addressing of a matrix screen of R rows and M columns takes place row by row (row time=$T_R$) during a frame of duration $T_t$ equal to or greater than $L.T_R$. During the addressing of each row, the data to be displayed on the M pixels (image elements) of said row are simultaneously applied to the M screen columns.

Hereinafter, reference will also be made to row sub-times. Thus, during the selection of the same row, it is envisaged to be able to apply to the columns (i.e. to the same pixels) S successive informations during S row subtimes of duration equal to $T_R/S$. However, if the use of row sub-times is preferable in the case of microtip screens, the process according to the invention is applicable in the same way when using sub-frames (in the case of TFT-LCD screens or thin film transistor type liquid crystal displays).

In the system according to the invention, the number of voltages used is equal to the number of levels switchable by the analog output multiplexers. The procedure does not involve breaking down the data item into low order/high order bits as in the prior art system shown in FIG. 1, but instead the complete word is passed into a transcoding matrix, which can e.g. be a PROM (programmable read only memory), which directly supplies the address of the voltage to be validated on the analog multiplexer of the output in question. Use is made of N voltages, which are adjusted in such a way that it is possible to describe the $Q_S$ desired grey tones. Two implementation variants can be envisaged.

Figure 2:
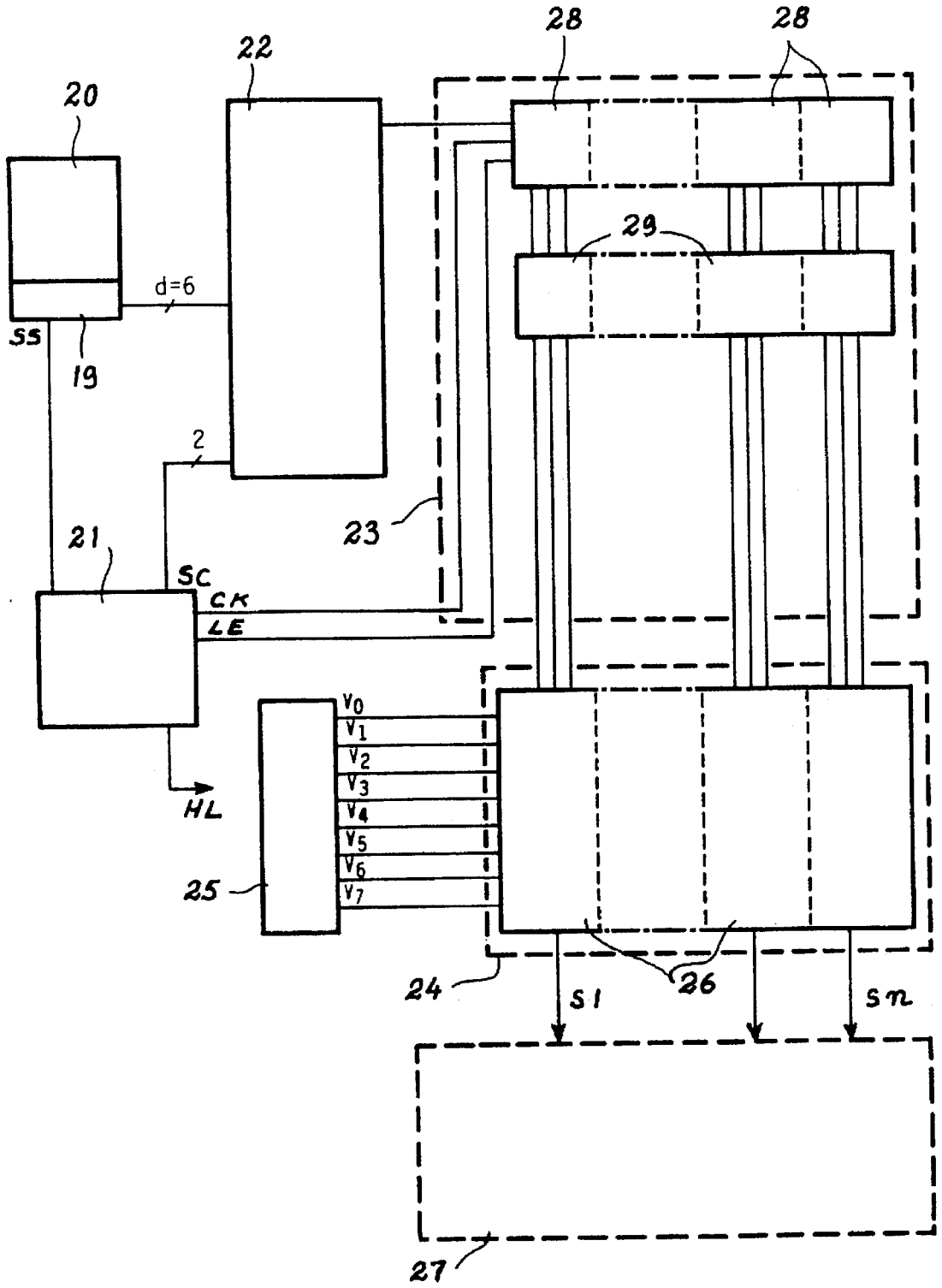
FIG. 2 illustrates a first variant of the system according to the invention.

A first variant of the system according to the invention and as shown in FIG. 2 comprises:

a source 20 of digital data to be displayed connected to a memory 19, a screen controller 21 supplying S addresses of the sub-times corresponding to the grey level addressing phases, said screen controller receiving sync signals SS from the data source 20, a transcoding circuit 22 connected to the digital data source 20 and receiving from the latter the binary addresses corresponding to the grey level code to be displayed, as well as the address of the sub-time taking place and supplying for each sub-time the address of the voltage to be switched, a data storage system 23 comprising shift registers 28 associated with storage registers or latches 29, connected to the transcoding circuit 22 and to the screen controller 21, a circuit for controlling the columns of the screen 24, and a generator 25 of N discrete voltages, in this case eight voltages.

During each sub-time, determined by the controller 21, the combination of 3 bits at the output of each associated register 29 corresponds to the address of a voltage $V_o$ to $V_7$. The selected voltage is therefore switched directly to the screen column control circuit 24. This circuit 24 is here realized by several analog multiplexers 26 having eight inputs and one output.

Figure 1:
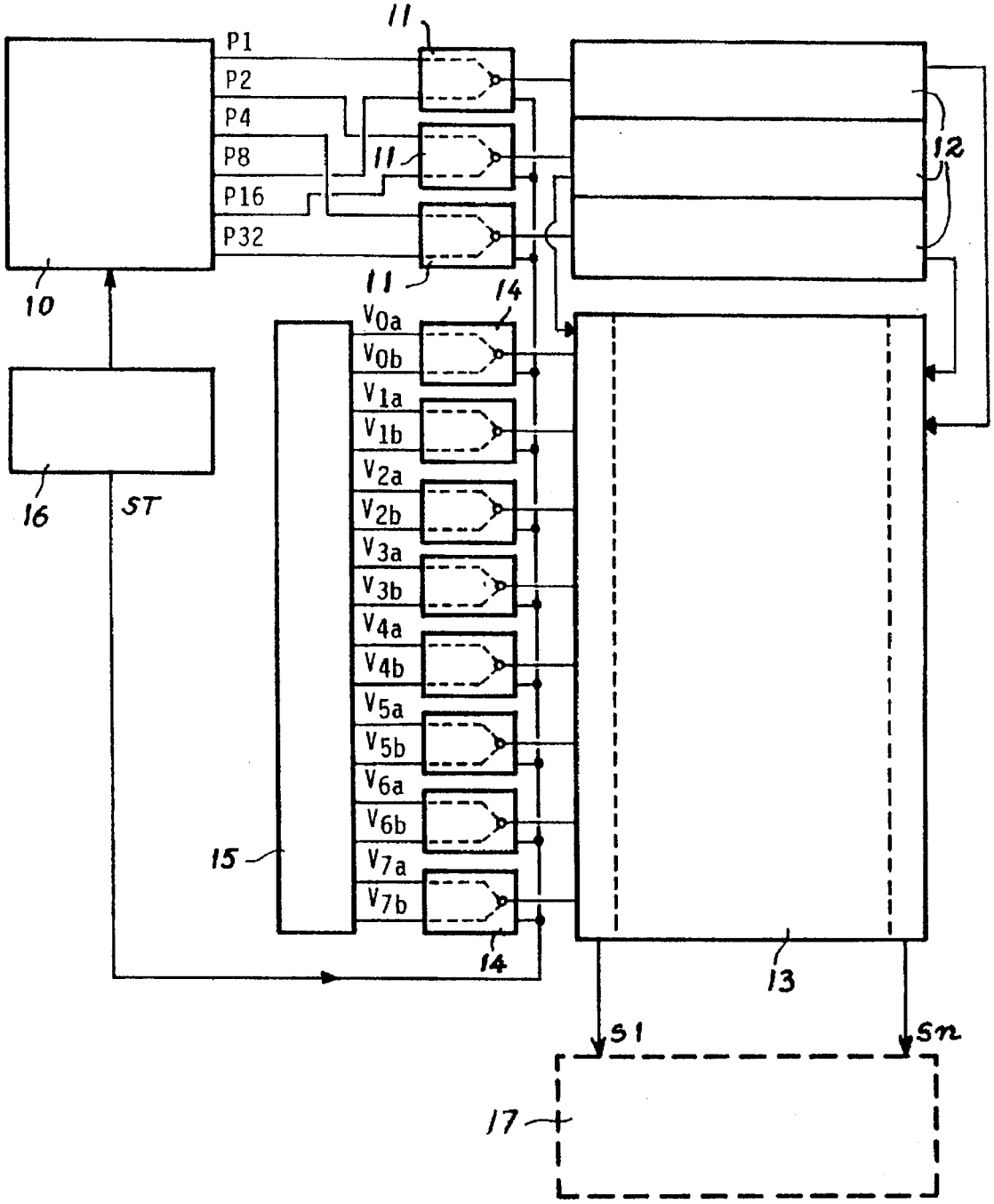
FIG. 1 illustrates a prior art system described hereinbefore.

As in the prior art system shown in FIG. 1, the known, row control circuit is not shown.

FIG. 2 is a mimic diagram example for $Q_S$=64 grey tones with N=8 voltages and S=3 sub-times.

The image information is supplied by the data source 20 in the form of words having d bits (for sixty four grey tones $Q_S=64=2^d=2^6$). On the basis of sync signals SS, the controller 21 supplies a data clock CK, an end of row sequence signal LE, a row synchronization clock HL and counting signals SC (sequence counter), which give the number of sub-times taking place.

In the case of a use of frame sub-times, it is necessary to use a page memory 19. S readings of said memory are performed, the sequence counter successively decoding the S sub-frames necessary for the formation of the image. The luminance or brightness of an image element or pixel coded on d bits and supplied by the data source 20 is stored in the page memory 19. The latter supplies said d bit word to the transcoding matrix 22, which produces a function word of the sequence counter on p bits (p such that $2^P$=N number of voltages selectable by the analog output multiplexers).

A shift register with p inputs receives said p bit word. A clock stroke CK passes it into the first register 28, each clock stroke CK advancing it by one block in the registers 28. When all the words corresponding to a display row (one word per column of the screen) have in this way been placed in the registers 28, the signal LE is validated and the preceding words pass into the associated registers 29. It is then possible to activate the clock HL and recommence the process for the following row whilst the associated registers 29 supply the analog output multiplexers 26 with the p bit word corresponding to the address of the voltage to be switched (Rq in this case HL=LE).

When all the rows of the screen 27 have been described in this way, the sequence counter is incremented and the preceding cycle is recommenced. The image is formed in the terms of the S sub-frames.

In the case of row sub-times, it is necessary to have a row memory 19. The data of a row are entered in a row memory 19 and then read again S times during the S row sub-times. In this case, the sequence counter is incremented for each sub-row, i.e. at the rate of the validations of the signal LE, whilst the clock HL is only activated once every S sub-rows. The data are processed by the transcoding matrix 22 and then by the array constituted by the shift registers 28 and the associated registers 29, as well as the output analog multiplexers 26.

Figure 3:
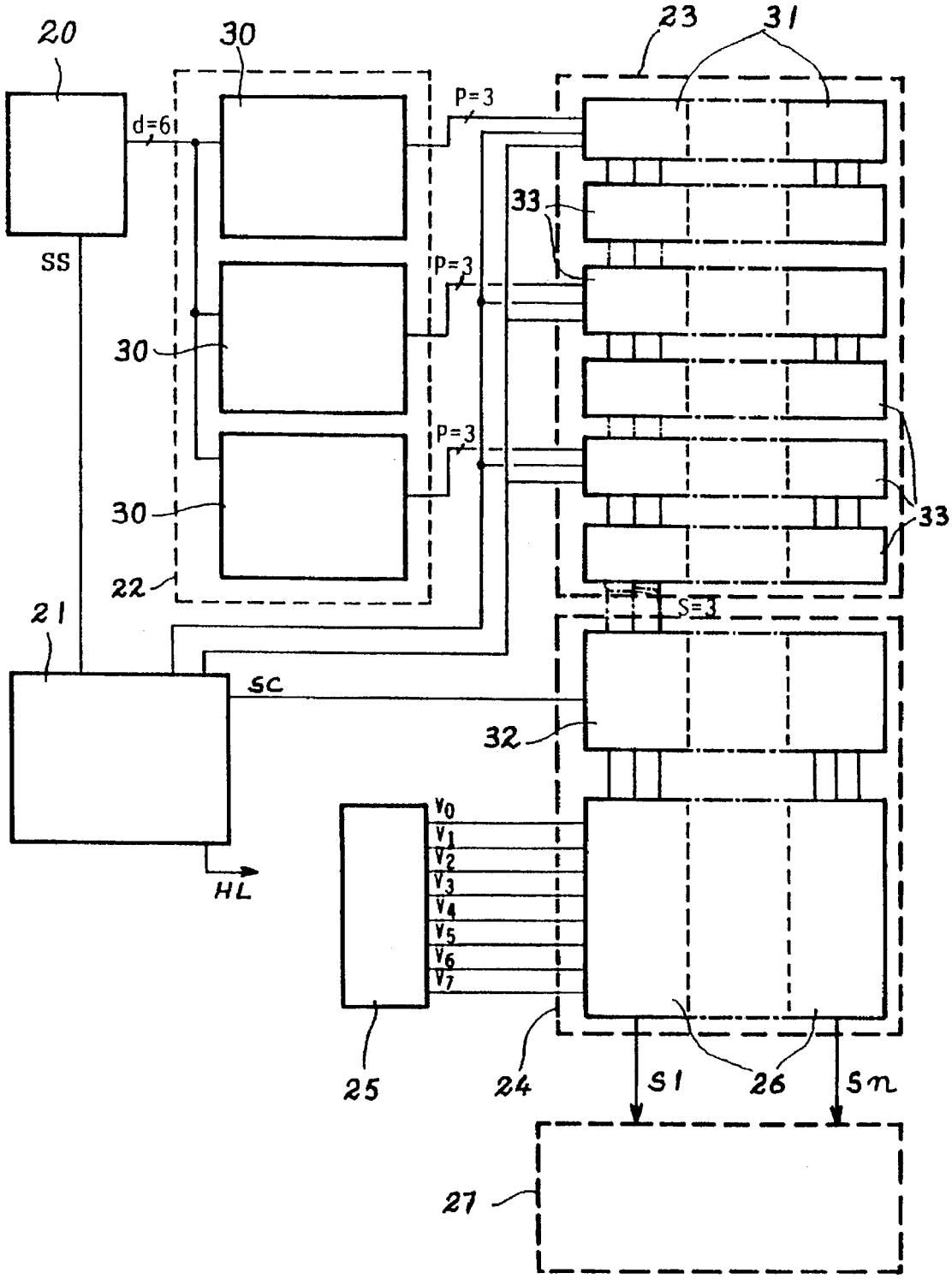
FIG. 3 illustrates a second variant of the system according to the invention.

In a second variant shown in FIG. 3, several modifications have been made to the system shown in FIG. 2:

the screen controller 21 is directly connected to the control circuit 24 of the screen 27, the transcoding circuit 22 has S transcoding submatrices 30, each corresponding to a sub-time, the data storage system has S shift registers 31 in parallel, each associated with a register 33 and each connected to a transcoding submatrix 30, and the screen control circuit 24 has analog multiplexers 26 controlling the screen and digital multiplexers 32 connected to the controller 21 and positioned between flip-flops associated with S shift registers 31 and the analog multiplexers 26.

In the case of row sub-times, it is found that a limitation to the preceding system shown in FIG. 2 is the sequential rereading of the same data, which requires the presence of a memory and in particular the recirculation of "data" information, which leads to an increase in the number of frequencies both at the transcoding matrix and at the clock CK of the shift registers of the screen driver circuit 23, 24.

In addition, in said second variant, the transcoding circuit 22 is constituted by the juxtaposing of S submatrixes 30, which make it possible to process in parallel data corresponding to S row sub-times. The screen driver array 23, 24 is constituted by S sub-arrays of shift registers 31+ associated registers 33 of p bits. The data corresponding to the S row sub-times are thus stored in the associated registers 33 and supplied to the inputs of the p among S logic multiplexers 32. In this case the HL signals (row synchronization clock) and LE signals (row sequence end) are identical. The logic multiplexers 32, controlled by the row sub-time counter, make it possible to switch the word of the sub-time in question to the output analog multiplexer 26, which thus validates the preselected voltage.

As the system according to the invention requires a measurement of the screen brightness or luminosity for a given setting, it is advantageously possible to reserve an ex-pupil zone addressed in similar manner to the remainder of the screen and coupled to a photodiode. Such a device, coupled to a controller makes it possible to automatically readjust the different output voltages of the circuits.

Figure 4:
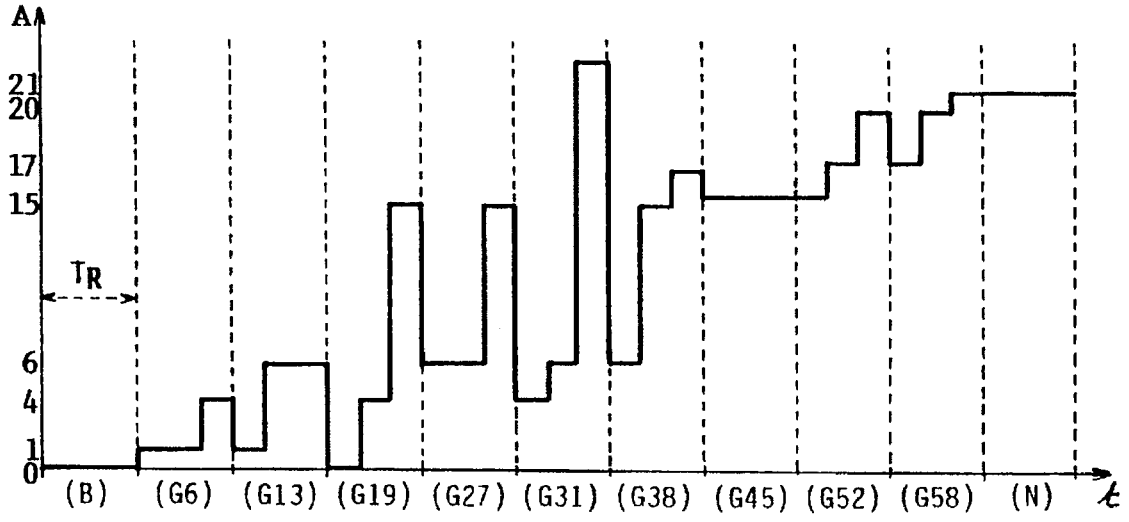
FIGS. 4 and 5 show two curves illustrating the operation of the system according to the invention.
Figure 5:
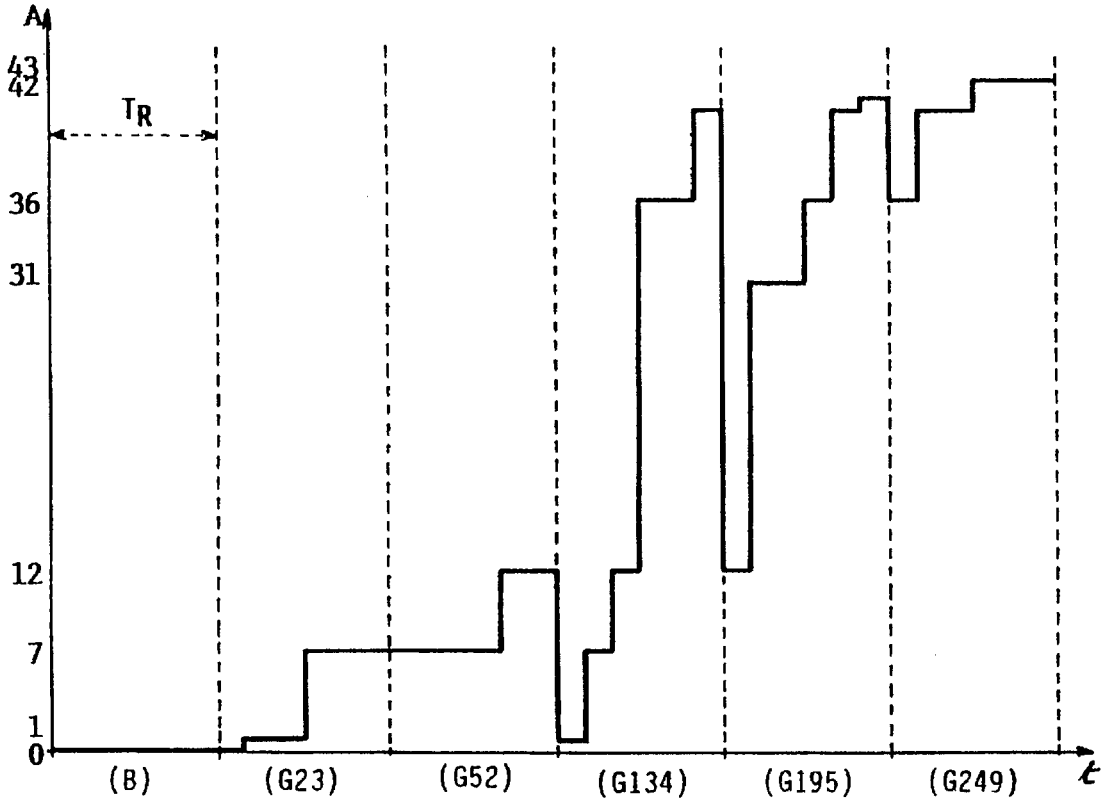

FIGS. 4 and 5 show the amplitude signals as a function of time obtained on a column output and using the row sub-times:

with N=8; $Q_S$=64:S=3; K=21 for FIG. 4;

and N=8; $Q_S$=256; S=6; K=43 for FIG. 5.

In these two drawings are shown the duration $T_2$ of a row time and ranges corresponding to the white:B. for different grey tints:G, corresponding to the white N, with three row sub-times for the first curve and six row sub-times for the second.

For the performance of the two variants described hereinbefore, the grey level display process according to the invention involves the following stages:

supplying from an image source 20 a data item in the form of a binary address, corresponding to the code of the grey level to be displayed, into a transcoding matrix 22, simultaneously supplying sync signals to the screen controller 21 so that it successively supplies the addresses of S sub-times either to the transcoding matrix 22, or to a logic multiplexer 31 positioned upstream of the analog multiplexer 26 controlling the screen, said analog multiplexer being connected to a generator of at least N discrete voltages, for a given sub-time, supply of the address of the voltage to be switched from the transcoding process to an array of shift registers 31 associated with storage registers 33, transfer of the content of the associated registers 33 into analog multiplexers 26 for controlling the column of the screen either directly, or across a logic multiplexer 32, and switching the selected voltage to the column of the screen 27.

The stage of generating $N=2^p$ discrete voltages will now be studied. S is the number of row sub-times used, Q the number of grey levels and N the number of voltages available on the output multiplexers of the circuits used.

With each voltage level Vi is associated a brightness level L(Vi) (or transmission for a passive screen). For effecting the time sum of S brightness levels and thus achieving a large number of greys, it is necessary to allocate coefficients to these N brightness levels.

As the contrast of a screen is defined as the ratio of the maximum/minimum brightnesses, an infinite contrast is assumed on allocating the value 0 as the coefficient of grey 0. In practice, there is always a residual brightness designated $\epsilon$, so that $L(V_0)=\alpha\epsilon$ designates the brightness.

According to the invention, the possible grey level number is dependent on the number of voltages usable (available on the circuit) and the number of sub-times:

| | |
|---|---|
| if S is uneven, | $Q = S(aS^2 + 2S(a+1)) + 1$ |
| if S is even, | $Q = S(aS^2 + S(3a+2) + a) + 1$ |
| with $a = N(/4) - 1$. | |

N=4 is a special case corresponding to a sub-case of N=8. For N=4, a=1 is taken by default and the brightnesses are taken such that:

$L(V_0)=\alpha\epsilon$ $L(V_1)=\alpha+L(V_0)$ $L(V_N-2)=\alpha(K_a-1)+L(V_0)$ $L(V_{N-1})=\alpha K_a+L(V_o)$ with $K_a-1=S+1$, i.e. $K_a=S+2$.

The possible grey number $Q_{(N=4)}$ is then $Q_{(N=4)}=S\,K_a+1=S(S+2)+1=(S+1)^2$.

The following Table gives the selectable grey number Q as a function of N and S.

| | S | | | | | | | |
|---|---|---|---|---|---|---|---|---|
| N | 2 | 3 | 4 | 5 | 6 | 7 | 8 | ... |
| 4 | 9 | 16 | 25 | 36 | 49 | 64 | 81 | 100 |
| 8 | 27 | 64 | 141 | 226 | 391 | 540 | 825 | 1054 |
| 12 | 45 | 109 | 249 | 401 | 709 | 981 | 1521 | |
| 16 | 63 | 154 | 357 | 576 | 1027 | 1422 | | |
| 20 | 81 | 199 | 465 | 751 | 1345 | | | |

Adaptation of the maximum brightness level $L(V_{N-1})$ according to the desired grey number:

$Q_S$ is the grey number which it is wished to display and as it does not necessarily encounter the possible grey number Q, it is necessary to adapt the value of $K_a$ to $Q_S$, i.e.:

$$K_a > (Q_S - 1)/S$$

the optimum being the smallest possible integer corresponding to this criterion.

On e.g. treating the case N=8 and therefore a=1, $Q_S$=256, it is necessary to take S=6 and Q=391 with:

$$K_a \geqq (256-1)/6 = 42.5$$

and therefore:

$$K_1 \geqq 43.$$

As $K_a$ must be below (Q−1)/S, $K_a$ must be below 65. Thus, it is possible to choose for $K_a$ any random value between 43 and 65 and advantageously 43.

Determination of the coefficients $K_x$.

The coefficients $K_x$ with x between 1 and a are allocated to groups of four brightnesses.

The first group (N=4 excepted) still has the four coefficients 0, 1, S+1, 2S, with the following brightness values:

$L(V_0)=\alpha\epsilon$ $L(V_1)=\alpha+L(V_0)$ $L(V_2)=\alpha(S+1)+L(V_0)$ $L(V_3)=\alpha.2S+L(V_0)$.

The following four brightness groups are such that:

$L(V_4)=\alpha(K_1-2S)$ $L(V_5)=\alpha(K_1-(S+1))$ $L(V_6)=\alpha(K_1-1)$ $L(V_7)=\alpha K_1$ the relation between S and $K_1$ being:

| | |
|---|---|
| for S uneven | $K_1 \leqq S^2 + 4S$ |
| and for S even | $K_1 \leqq S^2 + 5S - 1.$ |

In the preceding example where N=8, $Q_S$=256 with S=6, we obtain the relation:

$K_1 \leqq S^2+5S-1=65$ where, because here $K_1=K_a$:

$K_a \leqq Q-1/S=65$

We therefore have the double inequation for $K_a=K_1$:

$K_a \geqq 43$ $K_a \leqq 65$

For minimizing the variations between the coefficients, the optimum is to take $K_a$=43, which in this example gives:

| | |
|---|---|
| $L(V_o) = 0 =$ | 0 |
| $L(V_1) = \alpha =$ | $\alpha$ |
| $L(V_2) = (S + 1)\alpha =$ | $7\alpha$ |
| $L(V_3) = 2S\alpha =$ | $12\alpha$ |
| $L(V_4) = (K_1 - 2S)\alpha =$ | $31\alpha$ |
| $L(V_5) = (K_1 - (S + 1))\alpha =$ | $36\alpha$ |
| $L(V_6) = (K_1 - 1)\alpha =$ | $42\alpha$ |
| $L(V_7) = K_1\alpha =$ | $43\alpha$ |

Still in exemplified manner, the case $Q_S$=64 with N=8 gives us Q=64 and S=3:

$$K_1 \leqq S^2+45=9+12=21$$

Therefore we take $K_1$=21, with the eight brightness settings such that:

| | |
|---|---|
| $L(V_o) = \alpha\epsilon$ | symbolized by 0 |
| $L(V_1) = \alpha + L(V_0)$ | symbolized by 1 |
| $L(V_2) = 4\alpha + L(V_0)$ | symbolized by 4 |
| $L(V_3) = 6\alpha + L(V_0)$ | symbolized by 6 |
| $L(V_4) = 15\alpha + L(V_0)$ | symbolized by 15 |
| $L(V_5) = 17\alpha + L(V_0)$ | symbolized by 17 |
| $L(V_6) = 20\alpha + L(V_0)$ | symbolized by 20 |
| $L(V_7) = 21\alpha + L(V_0)$ | symbolized by 21 |

It is possible to obtain the $Q_S$ grey levels given in the following table by associating with each of these signals three brightnesses (one for each of the sub-times $T_0$, $T_1$ and $T_2$).

| Grey No. | TO | T1 | T2 |
|---|---|---|---|
| 0 | 0 | 0 | 0 |
| 1 | 0 | 0 | 1 |
| 2 | 0 | 1 | 1 |
| 3 | 1 | 1 | 1 |
| 4 | 0 | 0 | 4 |
| 5 | 0 | 1 | 4 |
| 6 | 1 | 1 | 4 |
| 7 | 0 | 1 | 6 |
| 8 | 1 | 1 | 6 |
| 9 | 1 | 4 | 4 |
| 10 | 0 | 4 | 6 |
| 11 | 1 | 4 | 6 |
| 12 | 4 | 4 | 4 |
| 13 | 1 | 6 | 6 |
| 14 | 4 | 4 | 6 |
| 15 | 0 | 0 | 15 |
| 16 | 4 | 6 | 6 |
| 17 | 1 | 1 | 15 |
| 18 | 6 | 6 | 6 |
| 19 | 0 | 4 | 15 |
| 20 | 1 | 4 | 15 |
| 21 | 0 | 6 | 15 |
| 22 | 1 | 6 | 15 |
| 23 | 4 | 4 | 15 |
| 24 | 1 | 6 | 17 |
| 25 | 4 | 6 | 15 |
| 26 | 0 | 6 | 20 |
| 27 | 6 | 6 | 15 |
| 28 | 4 | 4 | 20 |
| 29 | 6 | 6 | 17 |
| 30 | 4 | 6 | 20 |
| 31 | 4 | 6 | 21 |
| 32 | 6 | 6 | 20 |
| 33 | 6 | 6 | 21 |
| 34 | 4 | 15 | 15 |
| 35 | 1 | 17 | 17 |
| 36 | 6 | 15 | 15 |
| 37 | 1 | 15 | 21 |
| 38 | 6 | 15 | 17 |
| 39 | 4 | 15 | 20 |
| 40 | 6 | 17 | 17 |
| 41 | 6 | 15 | 20 |
| 42 | 6 | 15 | 21 |
| 43 | 6 | 17 | 20 |
| 44 | 6 | 17 | 21 |
| 45 | 15 | 15 | 15 |
| 46 | 6 | 20 | 20 |
| 47 | 15 | 15 | 17 |
| 48 | 6 | 21 | 21 |
| 49 | 15 | 17 | 17 |
| 50 | 15 | 15 | 20 |
| 51 | 17 | 17 | 17 |
| 52 | 15 | 17 | 20 |
| 53 | 15 | 17 | 21 |
| 54 | 17 | 17 | 20 |
| 55 | 15 | 20 | 20 |
| 56 | 15 | 20 | 21 |
| 57 | 17 | 20 | 20 |
| 58 | 17 | 20 | 21 |
| 59 | 17 | 21 | 21 |
| 60 | 20 | 20 | 20 |

-continued

| Grey No. | TO | T1 | T2 |
|---|---|---|---|
| 61 | 20 | 20 | 21 |
| 62 | 20 | 21 | 21 |
| 63 | 21 | 21 | 21 |

The groups of four coefficients in general terms are built up on the basis of the model $K_x2S$, $K_x-(S+1)$, $K_x-1$, $K_x$ with x between 1 and a. These (N/4)−1 coefficients $K_x$ are respectively allocated to a group of four brightnesses, $K_x$ being such that:

if S is uneven: $K_x \leqq K_{x-1}+S^2+2S$ if S is even: $K_x \leqq K_{x-1}+S^2+3S-1$ We will now consider a new example with $Q_S=256$ and N=16. The Table of the number of possible greys gives Q=357 for S=4.

We therefore have a=(N/4)−1=3 and $K_aK_3 \geqq Q_{S-1}/S=255/4$ and therefore $K_3 \geqq 64$.

We then take for example $K_3=64$.

This gives $L(V_0)=\alpha\epsilon$ $L(V_1)=\alpha+L(V_0)$ $L(V_2)=\alpha(S+1)+L(V_0)=5\alpha+L(V_0)$ $L(V_3)=\alpha.2S+L(V_0)=8\alpha+L(V_0)$ $L(V_4)=\alpha(K_1-2S)+L(V_0)=(K_1-8).\alpha+L(V_0)$ $L(V_5)=\alpha(K_1-(S+1))+L(V_0)=(K_1-5).\alpha+L(V_0)$ $L(V_6)=\alpha(K-1)+L(V_0)$ $L(V_7)=\alpha K_1+L(V_0)$ $L(V_8)=\alpha(K_2-8)+L(V_0)$ $L(V_9)=\alpha(K_2-5)+L(V_0)$ $L(V_{10})=\alpha(K_2-1)+L(V_0)$ $L(V_{11})=\alpha.K_2+L(V_0)$ $L(V_{12})=\alpha(K_3-8)+L(V_0)$ $L(V_{13})=\alpha(K_3-5)+L(V_0)$ $L(V_{14})=\alpha(K_3-1)+L(V_0$ $L(V_{15})=\alpha.K_3+L(V_0)$ As $K_3$ is equal to 64, we have the last four brightnesses:

$L(V_{15})=64\alpha+L(V_0)$ $L(V_{14})=63\alpha+L(V_0)$ $L(V_{13})=59\alpha+L(V_0)$ $L(V_{12})=56\alpha+L(V_0)$ As $K_1$ and $K_2$ are determined on the basis of $K_3$, we then have multiple choices for $K_1$ and $K_2$:

| | | |
|---|---|---|
| $K_1 \leqq S^2+5S-1$ | i.e. $K_1 \leqq 35$ | |
| $K_2 \leqq K_1+S^2+3S-1$ | i.e. $K_2 \leqq K_1+27$ | |
| $K_3 \leqq K_2+S^2+3S-1$ | i.e. $64 \leqq K_2+27$ | i.e. $K_2 \geqq 37$ |

which gives the double inequation:

$K_1 \leqq 35$ $K_1+27 \geqq K_2 \geqq 37$ $K_1$ must be at the maximum equal to 35 and $K_2$ to 62.

It is possible to take for example $K_1=24$ and $K_2=46$, which gives the values of two intermediate brightness groups:

$L(V_4)=15\alpha+L(V_0)$ $L(V_5)=19\alpha+L(V_0)$ $L(V_6)=23\alpha+L(V_0)$ $L(V_7)=24\alpha+L(V_0)$ $L(V_8)=38\alpha+L(V_0)$ $L(V_9)=41\alpha+L(V_0)$ $L(V_{10})=45\alpha+L(V_0)$ $L(V_{11})=46\alpha+L(V_0)$ It is clear that by following these different phases, there is a choice between multiple practical solutions, both for the values of $K_x$ of an intermediate level and for combinations of possible brightnesses for a same grey level when $Q>Q_S$. Advantage can be taken of this redundancy for minimizing residual consumption problems, code reversals, couplings, etc.

For minimizing transitions, the combination of S values preferably takes place in accordance with a rising or falling arrangement. In the case of row sub-times, it is possible to follow a rising order for one row parity and a falling order for the other, so as to minimize voltage variations, both for a uniform grey range and for a random sequence of grey levels.

Figure 6:
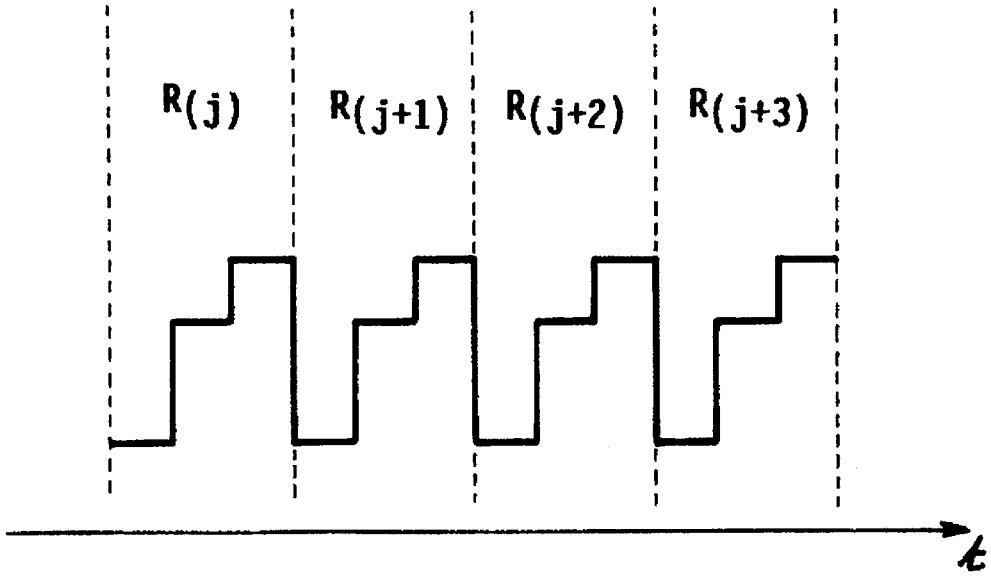
FIGS. 6 and 7 illustrate a stage of the process according to the invention.
Figure 7:
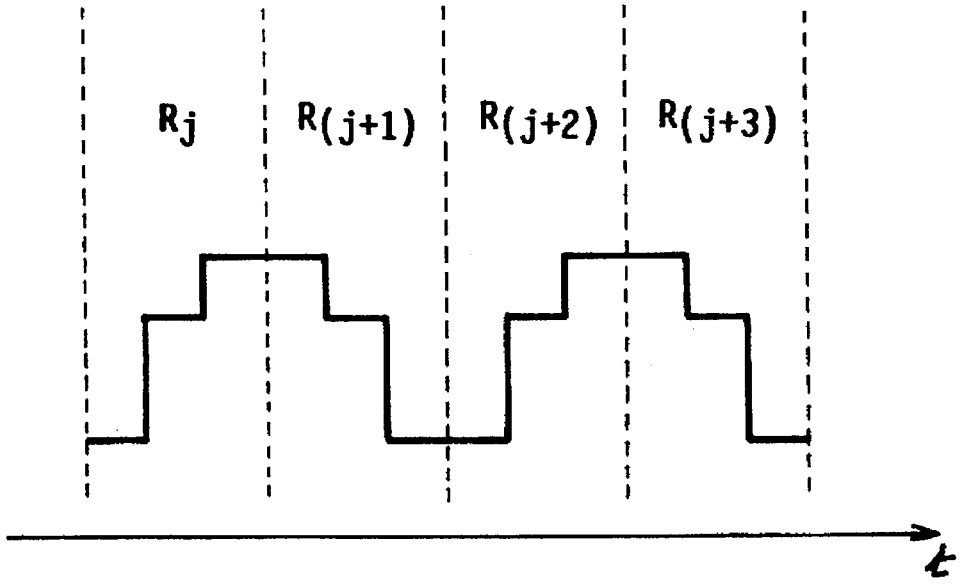

Thus, FIG. 6 shows a column signal using a rising arrangement for the successive rows $R_j$, $R_{(j+1)}$, $R_{(j+2)}$, $R_{(j+3)}$, j being the index of the row, whilst FIG. 7 shows a column signal using a rising arrangement and then a falling arrangement.

For a given grey level, when several coefficient choices are possible, preference is given to the combination minimizing the voltage (or coefficient) variations. For example, in the case N=8, S=3, $Q_S=64$, the level G=41 will be obtained by 6, 15, 20 rather than 0, 20, 21.

The redundancy can also be used by producing several combinations for the same grey and by reversing these different combinations between individual column outputs (in the case of optical effects linked with code reversals).

It is pointed out that a control mode making it possible to describe more than 256 grey levels can be useful for obtaining an image with a grey range having a response closer to a real image (γ correction).

The application of the process according to the invention to a colour screen in no way modifies the preceding description. The term "grey tones" here covers "tints". The essential difference is due to the data source supplying in parallel informations relating to the three colours red, green and blue. As is known to the expert, changing to the colour is obtained by one of the two following processes:

the first consists of crippling the column electrodes and placing in front of the said columns either a filter, or a phosphor coloured in accordance with the screen type and in this case addressing takes place in parallel of the three colours and it is necessary to triple the addressing device; and the second consists of successively validating the red, green and blue phosphors (EFM: switched anode) and in this case the same driver structure is retained as for a black and white screen, but adding a memory plane for each colour (row memory and frame in accordance with the validation of the colours at the row or frame) directly after the data source, a multiplexer making it possible to validate the data of the colour to be processed. The disadvantage of this mode is the tripling of the clock speeds, because it is necessary to process the three colours in series, in a time which must remain below that of the persistence of vision, which is approximately 20 ms.

The invention has been described only in an exemplary and preferred manner and components can be replaced by equivalent components without passing beyond the scope of the invention.

I claim:

1. A process for displaying different grey levels on a matrix screen formed from pixels arranged in accordance with R rows and M columns of images liable to have $Q_S$ grey levels, wherein each image is obtained by addition on each pixel, during a stage of writing image data row by row, during S sub-times of identical duration (rows or frames, S being equal to or greater than 2), of a succession of discrete brightnesses $L(V_i)$ chosen from among N ($N \geqq 4$) with $0 \leqq i \leqq N-1$, each brightness $L(V_i)$ being associated with a voltage $V_i$ applied to a corresponding column, said brightnesses being such that any grey tone value between 0 and $Q_S-1$ can be defined by the addition of S of said brightnesses, whatever the addressing phase and therefore the sub-times taking place, any brightness among the N possible brightnesses can be selected, said brightnesses being such that on defining the two extreme brightnesses $L(V_0)$ corresponding to the minimum brightness and $L(V_{N-i})$ corresponding to the maximum brightness by the following equations:

$$L(V_0)=\alpha\epsilon \text{ and } L(V_{N-1})=\alpha K_a+L(V_0)$$

$\epsilon$ being a low value and $\alpha$ a proportionality coefficient equal to $(L(V_{N-1})-L(V_0))/K_a$ in which $K_a$ is a coefficient with $a=(N/4)-1$, the N−2 other brightnesses then being expressed by the following relations, except in the case in which N=4:

$L(V_{N-2})=\alpha(K_a-1)+L(V_0)$ $L(V_{N-3})=\alpha(K_a-(S+1))+L(V_0)$ $L(V_{N-4})=\alpha(K_a-2s)+L(V_0)$ $L(V_{N-5})=\alpha(K_{a-1}+L(V_0)$ $L(V_{N-6})=\alpha(K_{a-1}-1)+L(V_0)$ $L(V_{N-7})=\alpha(K_{a-1}-(S+1))+L(V_0)$ $L(V_{N-8})=\alpha(K_{a-1}-2S)+L(V_0$ $L(V_{N-9})=\alpha K_{a-2}+L(V_0)$ $L(V_7)=\alpha K_1+L(V_0)$ $L(V_6)=\alpha(K_1-1)+L(V_0)$ $L(V_5)=\alpha(K_1-((S+1))+L(V_0)$ $L(V_4)=\alpha(K_1-2S)+L(V_0)$, $L(V_3)=\alpha.2S+L(V_0)$ $L(V_2)=\alpha(S+1)+L(V_0)$ $L(V_1)=\alpha+L(V_0)$, in which $K_x$, with x ranging between a and 1, with $a=(N/4)-1$, $K_x$ being coefficients respectively allocated to a group of four brightnesses, $K_x$ being such that:

for x=1, if S is uneven $K_1 \leqq S^2+4S$ if S is even $K_1 \leqq S^2+5S-1$ for x between (a−1) and 2 if S is uneven $K_x \leqq K_{x-1}+S^2 2S$ if S is even $K_x \leqq K_{x-1}+S^2+3S-1$ and for x=a, no matter what $S,(Q-1)/S \geqq K_a \geqq (Q_S-1)/S$, and in that these N selectable brightnesses are obtained by the adjustment of N voltages $V_0, \ldots, V_{N-1}$ and make it possible to obtain a selectable grey number $Q(Q \geqq Q_S)$ equal to:

if S is uneven: $Q=S\ (aS^2+(2a+2).S)+1$ if S is even: $Q=S(aS^2+(3a+2).(S-a))+1$;

and for the particular case in which N=4:

$Q=(S+1)^2$, $L(V_0)=\alpha\epsilon, L(V_1)=\alpha+L(V_0)$, $L(V_2)=\alpha.(S+1)+L(V_0)$, and $L(V_3)=\alpha(S+2)+L(V_0)$.

2. A process according to claim 1, comprising the following steps:

supplying from a source of images to be displayed (20) a data item in the form of a binary address, corresponding to the code of the grey level to be displayed, into a transcoding matrix (22), simultaneously supplying sync signals to a screen controller (21 ), so that it successively supplies the addresses of the S sub-times either to the transcoding matrix (22), or to a logic multiplexer (32) located upstream of the analog multiplexer (26) controlling the screen (27), said analog multiplexer being connected to a generator of at least N voltages, for a given sub-time, supplying the address of the voltage to be switched from the transcoding matrix to an array of shift registers (28, 31) associated with storage registers (29, 33), transfer of content of the associated storage registers (29, 33) to the analog multiplexers (26) for the control of the screen either directly or across a logic multiplexer (32), and applying the voltage to be switched to the column of the screen (27).

3. A process according to claim 2, wherein the addition of the brightnesses during the S sub-time takes place using combinations of voltage values in accordance with a rising or falling arrangement.

4. A process according to claim 3, wherein in the case of row sub-times a rising order is followed for one row parity and a falling order for the other row parity.

5. A system for performing the process according to any one of the preceding claims, wherein said system comprises:

a source of digital data (20) to be displayed, a screen controller (21) receiving sync signals (SS), from the data source and which supplies S addresses of sub-times, a generator of at least N voltages, a data storage system (23), a screen column control circuit (24), a discrete voltage generator (25), and a transcoding circuit (22) connected to the digital data source (20) for receiving from the latter binary addresses corresponding to the code of the grey level to be displayed and supplying the address of the voltage to be switched to a control circuit (24) for validating one from among N discrete analog voltages.

6. A system according to claim 5, wherein the screen controller (21 ) is connected to the data storage system (23) and to the transcoding circuit (22), the data storage system (23) comprises shift register (28) associated with storage registers (29), and the column control circuit of the screen (24) has several circuits (26) connected to the generator, and for selecting one among several discrete voltages for controlling each column of the screen (27).

7. A system according to claim 5, wherein the screen controller (21) is directly connected to the screen control means, the transcoding circuit (22) has transcoding submatrices, each corresponding to a sub-time, the data storage system (23) has shift registers (31) in parallel and each associated with a register (33) and each connected to a transcoding submatrix, the screen column control circuit has circuits (26) connected to the generator, and for selecting one among several discrete voltages for controlling each column of the screen, and digital multiplexers (32) are connected to the controller and positioned between the associated registers (32) and said circuits (26).

* * * * *

UNITED STATES PATENT AND TRADEMARK OFFICE

CERTIFICATE OF CORRECTION

PATENT NO. : 5,638,091

DATED : June 10, 1997

INVENTOR(S) : Denis Sarrasin

It is certified that error appears in the above-indentified patent and that said Letters Patent is hereby corrected as shown below:

Claim 1, Col. 13, insert -- ) -- (end parentheses) at the end of line 27.

Claim 1, Col. 13, insert -- … -- at the end of line 28.

Claim 1, Col. 13, line 45, "$K_x \leq K_{x-1}+S^2 2S$" should be -- $K_x \leq K_{x-1}+S^2+2S$--.

Signed and Sealed this

Twenty-first Day of July, 1998

Bruce Lehman

*Attest:*

BRUCE LEHMAN

*Attesting Officer*

*Commissioner of Patents and Trademarks*